United States Patent [19]

Casinelli

[11] 4,286,968

[45] Sep. 1, 1981

[54] SOLID FUEL COMPOSITION

[75] Inventor: Dominic L. Casinelli, Houston, Tex.

[73] Assignee: James E. Harrell, Houston, Tex. ; a part interest

[21] Appl. No.: 179,118

[22] Filed: Aug. 18, 1980

[51] Int. Cl.[3] ..... C10L 5/00

[52] U.S. Cl. ..... 44/1 R; 44/21; 44/25; 44/26

[58] Field of Search ..... 44/1 R, 7.5, 16 R, 16 E, 44/21, 25, 26

[56] References Cited

U.S. PATENT DOCUMENTS

| | | | |
|---|---|---|---|
| 1,407,101 | 2/1922 | Tommasi et al. . | |
| 1,452,239 | 4/1923 | Gutlin . | |
| 1,752,935 | 4/1930 | Wyler . | |
| 1,860,743 | 5/1932 | Komarek | 44/26 |
| 1,895,955 | 1/1933 | Wygodsky . | |
| 2,161,385 | 6/1939 | Ringer | 44/7 |
| 2,391,988 | 1/1946 | Loane et al. | 44/7.5 |
| 2,581,441 | 1/1952 | Raab | 44/7 |
| 2,610,113 | 9/1952 | Fischer et al. | 44/7 |
| 2,915,560 | 12/1969 | Steinbardt et al. | 260/615.5 |
| 3,460,921 | 8/1969 | Winkler | 44/7 |
| 3,615,286 | 10/1971 | VanderLinden et al. | 44/7 D |
| 3,718,445 | 2/1973 | Trofkin et al. | 44/7 C |
| 3,754,877 | 8/1973 | Klug | 44/7 B |
| 3,795,556 | 3/1974 | Sippel et al. | 149/109 |
| 3,801,292 | 4/1974 | Tanner | 44/7 |
| 3,824,085 | 7/1974 | Teng et al. | 44/7 B |
| 3,964,880 | 6/1976 | Siegrist | 44/7 B |
| 4,001,152 | 1/1977 | Leonhardt | 260/18 |
| 4,042,313 | 8/1977 | Pierce | 44/1 R |
| 4,083,697 | 4/1978 | Smith et al. | 44/7 |

FOREIGN PATENT DOCUMENTS

| | | | |
|---|---|---|---|
| 1046250 | 10/1966 | United Kingdom | 44/25 |

*Primary Examiner*—Carl F. Dees

*Attorney, Agent, or Firm*—Pravel, Gambrell, Hewitt, Kirk, Kimball & Dodge

[57] ABSTRACT

A solid moldable fuel composition comprising an acetal resin containing from about 0.5 to about 1.5% by weight fumed silica to increase the flame temperature at which the acetal resin will burn. The composition may further include an antimony oxide flame retardant in an amount of from about 0.05 to about 0.8% by weight to regulate the flame temperature of the composition between about 1500° and 2500° F. and increase the combustion time of the composition. Further ingredients such as a cellulose ester and alkali or alkaline earth metal carbonate may be incorporated to facilitate ignition of the composition and increase its combustion time.

15 Claims, No Drawings

SOLID FUEL COMPOSITION

BACKGROUND OF THE INVENTION

A need has long existed for a solid fuel composition that is:

(a) readily storable with long shelf life without special packaging or handling;

(b) readily ignitable when combustion is desired, yet resistant to ignition under normal shipping or storage conditions;

(c) capable upon combustion of generating a sufficiently hot flame temperature to provide useful quantities of heat—such as for cooking or other purposes; and (d) capable of providing a long-lasting fuel source yet which is also compact and readily transportable.

The art discloses many efforts to develop a solid fuel source which embodies some or all of the above features. Thus, in connection with the problem of handling, transportation and storage, many efforts have been directed to the formulation of jellied gasoline or hydrocarbon fuels. For example, see U.S. Pat. Nos. 2,581,441; 2,610,113; 3,460,921; 3,718,445; 3,824,085 and 3,795,556. Solidified alcohol based fuels have also been disclosed. See U.S. Pat. Nos. 1,752,935; 3,754,877 and 3,964,880. Solid fuel formulations which in part comprise a copolymer formaldehyde resin, such as urea-formaldehyde or phenol-formaldehyde, have been disclosed. See. U.S. Pat. Nos. 3,615,286; 3,801,292; 4,001,152 and 4,083,697. Solid fuel compositions comprising polymers of formaldehyde, such as paraformaldehyde and linear hydrated formaldehyde polymers, and of acetaldehydes, such as paraldehyde and metaldehyde, have been suggested. See U.S. Pat. Nos. 1,407,101; 1,452,293; 1,895,955; 2,161,385 and 2,915,560. Paraformaldehyde resins are unsatisfactory in that they are water soluble, which presents storage problems, and emit the sharp odor of formaldehyde when combustion is extinguished. U.S. Pat. No. 2,915,560 discloses a process for producing a linear hydrated formaldehyde polymer, that in some respects appears to possess properties similar to those of acetal resins. It is stated that this material is compressible into dense hard fuel tablets which burn with a non-luminous flame that does not give off a detectable odor of formaldehyde.

However, it does not appear that any practical solid fuel composition employing a formaldehyde type resin—including acetal type resins—has yet been developed. This apparently stems from the fact that an acetal resin alone, although it is known to have clean-burning characteristics resulting in no smoke generation, nevertheless will not burn with sufficient heat liberation to be useful as a practical heat source for cooking or other like uses.

Acetals are slow burning resins. Their flame temperature is about 600° F., which in itself may appear to be sufficient for cooking purposes until it is realized that the flame of the burning resin is extremely localized in nature. That is, the height to which the flame extends above the combustion surface is very small, thus the heat liberated by the flame is extremely localized. If the flame produced by combustion of a pure acetal resin is to be utilized, the item to be heated thereby must be brought into such close proximity to the combustion surface as to impede the free flow of oxygen across the combustion surface, thus producing a very unstable flame. If the item to be heated is held away from the combustion surface so as not to impede the flow of oxygen thereto, then any disturbance of the air between the combustion surface and the object would dissipate the upward flow of heat generated by the low temperature flame and would thereby preclude a useful quantity of heat from reaching the object to be heated.

Clearly, an acetal resin alone has not proven satisfactory as a solid fuel source for outdoor use.

SUMMARY OF THE INVENTION

The invention comprises a moldable solid fuel composition having a flame temperature controllable between about 600° F. and 3000° F. and particularly within the region of about 1900° F., comprising: from about 94 to about 98% by weight of a stabilized acetal resin; from about 0.5 to about 1.5% by weight of fumed silica; from about 1 to about 3% by weight of an alkaline earth metal carbonate; from about 0.1 to about 1.0% by weight of a cellulose ester; and, from about 0.05 to about 0.80% and preferably from about 0.30 to 0.60% by weight of a flame retardant such as antimony trioxide. A fuel tablet of the above composition is readily ignitable by an open flame, quickly reaches its maximum combustion temperature and burns with an intense local flame temperature that liberates sufficient quantities of heat suitable for cooking or other uses.

DESCRIPTION OF THE PREFERRED EMBODIMENTS

The basic fuel ingredient of the solid fuel composition of this invention is a stabilized acetal resin, the combustion properties of which are modified by certain additives which will be explained below.

Acetal resins are high molecular weight linear polymers of formaldehyde or trioxane. Acetal resins, or polyoxymethylenes, are produced by the anionically catalyzed polymerization of pure formaldehyde (99.9% or better $CH_2O$) in the presence of an inert solvent, suchas hexane, at reaction temperatures of from about −58° F. to about +158° F. Suitable anionic polymerization catalysts include amines, cyclic nitrogen containing compounds, arsines, stibines, and phosphines. The acetal polymer so produced is insoluble in the reaction solvent and is continuously removed therefrom as a slurry. Acetal resins are also produced in an inert solvent by the ring opening of pure trioxane in the presence of catalysts such as borontrifluoride etherate. Usually, the thermal and chemical stability of the acetal resin is improved by esterification of the hydroxy end groups of the polymer, such as by reaction with acetic anhydride. The capping of the end hydroxyl groups inhibit the depolymerization of the resin at normal temperatures. Such resins are referred to as stabilized acetal resins.

Acetal resins have good mechanical properties, resulting from the ability of the oxymethylene chains to pack together in a highly ordered crystaline configuration, and are the strongest and stiffest of the non-reinforced thermo plastics. Typically, acetal resins are about 75% crystaline and have a melting point of about 356° F. Such resins have negligibly small moisture absorption rates and are resistant to all common solvents at room temperature. Acetal resins may be processed by conventional molding and extrusion techniques into articles of any desired size and shape.

Acetal resins are available commercially from E. I. DuPont De Nemours & Company, under the trademark DELRIN®, as well as other plastics manufacturers.

Acetal resins, such as DELRIN®, are commercially available as spherical pellets approximately 0.100 inches in diameter, or as cylindrical pellets measuring 0.125 inches in diameter and 0.09 inches in length.

The acetal resin is employed as the major constituent of the solid fuel composition of this invention. The resin itself, without addition of modifying constituents, will cleanly burn with a highly localized flame having a temperature of about 600° F. at a linear burn rate of about 1.1 inches per minute when a specimen of 0.125 inch thickness is burned in a horizontal position. Generally, this flame temperature is too low to provide useful quantities of heat in an outdoor environment because of the localized nature of the flame. It is necessary to modify the combustion characteristics of the resin if it is to be formulated into a practical and compact solid fuel source.

Surprisingly, it has been found that the flame temperature at which an acetal resin burns may be significantly increased by the addition of fumed silica thereto in intimate admixture.

Fumed silica is produced by flame or fume processing of silicone tetrachloride in the presence of hydrogen and oxygen. It has an average particle size of 7 to 14 millimicrons, a low moisture content and a large external surface area of from about 200–400 $m^2/g$. It is commercially available from the Cabot Corporation under the trademark "Cab-O-Sil".

Fumed slica when added to an acetal resin on a weight basis of about 0.5 to about 1.5% increases the resin's combustion temperature to a range of from about 750° F. to about 3000° F., respectively. Generally, the addition of about 1% by weight of fumed silica gives an acetal resin a combustion temperature of about 3000° F. This is approximately the maximum combustion temperature that can be obtained. Although the addition of fumed silica within the range of about 1.0 about 1.5% by weight may increase the combustion temperature still further, generally the increase over about 3000° F. is relatively insignificant, and additions greater than about 0.1% by weight are generally not required. For many purposes a flame temperature of 3000° F. would be excessively high. Therefore, when a lower temperature is desired, the amount of fumed silica may be decreased. The addition of fumed silica to the extent of about 0.75% by weight produces an acetal resin which burns with a flame temperature of about 1900° F. The flame temperature of the acetal-silica fuel composition may be varied between about 750° F. to about 3000° F. by suitably varying the fumed silica content between the range of about 0.5 to about 1.0% by weight.

The mechanism by which fumed silica produces an increased flame temperature is not clear. It may function to catalyze the rate at which the surface region of the acetal resin combines with oxygen. Or, it may serve to promote a faster combustion rate by facilitating the admixture of air with that surface film of acetal resin which constitutes the combustion surface. It has been noted that acetal resins containing fumed silica burn with a combustion surface that vigorously froths and bubbles, thus permitting a more intimate and complete admixture of oxygen with the material undergoing combustion. Frothing is believed to be produced by the liberation of absorbed moisture (absorbed during the normal handling of fumed silica) from the fumed silica as the temperature of the fumed silica within the combustion zone exceeds about 212° F. to about 390° F.

For many purposes, especially cooking purposes, a flame temperature of from about 2500° F. to about 3000° F. is too great. The quantity of heat delivered at this temperature may melt most of metallic cooking utensils. Since the flame is extremely localized, even where the utensil itself will withstand the temperature, the localized flame would create a hot spot on the utensil surface which would over cook food in that area and cause it to stick to the cooking surface of the utensil.

Although the flame temperature of the acetal resin may be controlled within a broad range solely by varying the amount of added silica, this is not generally the preferred method of control. The addition of fumed silica causes the acetal resin to burn at a significantly increased rate of combustion. It is, therefore, preferable to add fumed silica to the extent of about 1% by weight to achieve an increased flame temperature and, in order to regulate the temperature downward to a desired range and to offset the increased combustion rate, to also add a suitable flame retardant to the acetal-silica mixture.

It has been found that the temperature of the acetal resin-silica composition may be controlled within relatively broad limits, between about 600° F. to about 3000° F., and specifically between about 1500° F. to 1900° F., by the addition thereto of a flame retardant containing oxides of antimony. Thus, for compositions containing about 1% by weight fumed silica, an antimony trioxide flame retardant may be added in amounts which vary from about 0.05 to about 0.8% by weight to the total composition.

Antimony trioxide has long been used as a flame retardant for plastics. To be effective however, it must be used with a source of available chlorine. However, in the fuel composition of this invention, antimony trioxide is used not as a flame retardant but as a flame temperature depressant. Therefore, no additives should be included in the fuel composition of this invention which would act as an available source of chlorine while the composition burns.

In a fuel composition containing acetal resin with 1% by weight fumed silica, with antimony trioxide added, the flame temperature of the fuel composition may be varied from about 2500° F. at an addition rate of antimony trioxide of about 0.2 wt.% to about 1500° F. at an addition rate of about 0.8 wt.%. The flame temperature may even be depressed to that of the pure resin, about 600° F., by the addition of up to about 1.0% by weight antimony trioxide. For any given amount of added fumed silica, the final flame temperature of the fuel composition is an approximate linear function of the amount of antimony trioxide added. By appropriate selection of the relative amounts of these two ingredients, the flame temperature and, hence, the ultimate heat output per unit time of a solid fuel composed of acetal resin, may be varied from a low of about 600° F. for the acetal resin alone to a high of about 3000° F. wherein only fumed silica is added to the resin. For cooking purposes a flame temperature of about 1900° F. is generally the most desirable. This temperature may be achieved in an acetal resin composition containing about 1.0% by weight fumed silica by the addition thereto in intimate admixture of about 0.5% by weight antimony trioxide flame retardant.

The addition of antimony trioxide substantially decreases the combustion rate of the solid fuel composition compared to an acetal resin alone and, therefore, counter balances the tendency of fumed silica to increase the combustion rate. Hence, acetal fuel compositions containing fumed silica and antimony oxide flame retardants within the ranges described above comprise a solid fuel composition capable of sustaining combustion for long durations. Generally, a composition as described above will burn at the rate of approximately twenty-two minutes for each ounce of composition.

To ensure that the solid fuel composition may be readily ignited without requiring prolonged exposure to an ignition source, cellulose ester, preferably cellulose acetate, is added to the acetal resin composition in an amount from about 0.1 to about 1.0% by weight. The acetal resin itself will ignite without the presence of cellulose acetate, but ignition requires exposure to an open flame or another ignition source for an amount of time sufficient to bring that part of the surface so exposed to a temperature exceeding the flash ignition temperature of the resin, about 613° F. Thereafter, the flame spreads slowly across the surface area as regions adjacent to the combustion surface are heated thereby to their flash ignition temperature.

Thus, without the addition of cellulose acetate, the acetal resin is difficult to ignite, especially in an outdoor environment, and requires an inconveniently long period of time to reach its maximum heat output since the flame spreads slowly across its surface. The addition of cellulose acetate overcomes both of these deficiencies in the acetal resin. Additionally, the addition of cellulose acetate to the composition produces a colored flame—a red glow—which from the standpoint of safety is desired in preference to the non-luminous flame that would result in the absence of cellulose acetate addition. The presence of cellulose acetate, uniformly distributed throughout the resin in an amount from about 0.1 to about 1.0% by weight, lowers the time required for ignition to the point that a resin may be conveniently ignited by exposure to a match. Additionally, the presence of cellulose acetate in the resin causes the flame front to spread across the resin surface more rapidly, significantly decreasing the period of time from ignition until the composition reaches its maximum heat output.

To make the composition more economical to manufacture and to decrease its density which thereby also increases its effective combustion time, an alkali or alkaline earth metal carbonate may be added as a filler to the composition in an amount from about 1 to about 3% by weight. The preferred carbonate is calcium carbonate. Calcium carbonate is the purest filler and contains no toxic impurities which would be liberated during combustion. Calcium carbonate is preferably added in an amount of about 2% by weight of the final composition.

If desired, the final fuel composition may be colored by the addition of any of the commonly available organic pigments. Inorganic pigments are not preferred since they may liberate toxic gases upon combustion. With the addition of color pigments the fuel composition may be conveniently color coded in accordance with its designed combustion time or temperature.

The final solid fuel composition will contain at least the following components: acetal resin as the basic fuel ingredient and fumed silica to increase the flame temperature of the acetal resin. Also, preferably added to the fuel composition is antimony trioxide to regulate the flame temperature to within an useful range and to increase the effective combustion time of the composition. Cellulose acetate is added to facilitate the convenient ignition of the composition, the rapid achievement of maximum heat output from the resin after ignition and to produce a colored flame. If desired, calcium carbonate may be added to decrease the composition's density, thus increasing its combustion time and to provide for the more economical production of the composition.

The final fuel composition generally comprises about 94 to 98 wt.% acetal resin, 0.5 to 1.5 wt.% fumed silica, 0.05 to 0.8 wt.% flame retardant containing an antimony oxide, and may further contain from about 0.1 to about 1.0 wt.% cellulose acetate and about 1.0 to 3.0 wt.% calcium carbonate.

The solid fuel composition may be compounded by any conventional type of processing provided the processing employed produces a uniform distribution of the additives, namely fumed silica, antimony trioxide, cellulose acetate and calcium carbonate or other equivalent ingredients, throughout the acetal resin. This may, for instance, be accomplished by high shear melt mixing of the acetal resin with the additives in a twin-screw compounding extruder. Prior to compounding-component mixing and melt blending the acetal resin should first be treated to remove contaminating metallic components which may liberate toxic fumes upon combustion. Thus, a magnet should be passed over the pure acetal resin to remove ferromagnetic impurities which may have been included therein by reason of the method by which it was produced. Generally, the demagnetization of the acetal resin will remove about 1 oz. of contaminated particles for every hundred pounds of acetal resin used.

The final fuel composition is processible by conventional methods such as extrusion or injection molding. The most convenient form for outdoor use of the solid fuel composition is as a tablet form. Hence, the composition may be extruded into solid bars or rods of any desired surface area and severed into any length.

It has been found that the combustion rate for such tablets is of somewhat shorter duration when the tablet is extruded into a hard, dense and compact form as compared to tablet form comprising an aggregate of slightly fused pellets wherein the fuel composition is initially prepared as a pelletized form, having an average pellet diameter of about 0.10 inch and then fused under conditions to produce an aggregate tablet comprising slightly fused pellets, such a pelletized tablet has a longer combustion time than would a solid tablet containing a comparable amount of the fuel composition.

A solid dense fuel tablet made in accordance with the above description and containing at least about 1% by weight fumed silica and about 0.5% by weight antimony trioxide burns with a flame temperature of about 1900° F., has a flash ignition temperature of about 630° F., a specific heat of about 0.35 BTU/lb./° F. and a heating value of about 8051 BTU/lb.

Fuel tablets composed of the solid fuel composition of this invention are especially suited for use in the portable stove disclosed and described by my co-pending United States patent application entitled "Portable Stove", Ser. No. 179,119, filed Aug. 18, 1980. A stove of the structure described therein is particularly suited to bring a utensile containing a material to be cooked or heated into close proximity to the combustion surface of such fuel tablets while insuring that the combustion surface receives an adequate oxygen supply to support a steady combustion.

Although the invention has now been described in terms of its preferred embodiments, those of ordinary skill in the art, in view of this description, may make changes and modifications thereto without departing from the scope and spirit of the invention as described above or claimed hereafter.

I claim:

1. A solid moldable fuel composition which upon combustion produces a flame temperature of from about 750° F. to about 3000° F., comprising:

an acetal resin containing from about 0.5 to about 1.5% by weight fumed silica.

2. The composition of claim 1, wherein fumed silica is present in an amount of from about 0.5 to about 1.0% by weight of the acetal resin.

3. The composition of claim 1, further including:

a flame retardant containing an oxide of antimony in an amount of from about 0.05 to about 0.8% by weight of the acetal resin.

4. The composition of claim 3, wherein the flame retardant is antimony trioxide.

5. The composition of claim 4, wherein antimony trioxide is present in an amount of from about 0.05 to about 0.8% by weight of the acetal resin.

6. The composition of claim 3, further including a cellulose ester in an amount of from about 0.1 to about 1.0% by weight of the acetal resin.

7. The composition of claim 6, wherein the cellulose ester is cellulose acetate.

8. The composition of claim 6, further including an alkali earth metal carbonate or an alkaline earth metal carbonate in an amount of from about 1.0 to about 3.0% by weight of the acetal resin.

9. The composition of claim 8, wherein the carbonate is calcium carbonate.

10. A solid moldable fuel composition which upon combustion produces a flame temperature of between 1500° to 2500° F., comprising:

an acetal resin containing at least about 0.75% by weight fumed silica.

11. The composition of claim 10, wherein the fumed silica is present in an amount of at least about 1% by weight and the acetal resin further contains from about 0.2 to about 0.8% by weight antimony trioxide.

12. The composition of claim 11, wherein the antimony trioxide is present in an amount of about 0.5% by weight and the flame temperature of the fuel composition is about 1900° F.

13. The composition of claim 1 or 10, wherein the composition is a compact tablet.

14. The composition of claim 11 or 12 wherein the composition is in a tablet form.

15. The composition of claim 14 wherein the tablet comprises a slightly fused aggregate of pellets.

* * * * *